US009415318B1

(12) United States Patent
Harris

(10) Patent No.: US 9,415,318 B1
(45) Date of Patent: Aug. 16, 2016

(54) RECREATIONAL WATER SPRAY APPARATUS

(71) Applicant: Timothy Harris, Gilbert, AZ (US)

(72) Inventor: Timothy Harris, Gilbert, AZ (US)

( * ) Notice: Subject to any disclaimer, the term of this patent is extended or adjusted under 35 U.S.C. 154(b) by 0 days.

(21) Appl. No.: 14/694,867

(22) Filed: Apr. 23, 2015

(51) Int. Cl.

| | |
|---|---|
| ***F41J 5/14*** | (2006.01) |
| ***A63G 31/00*** | (2006.01) |
| *A63B 63/00* | (2006.01) |
| *A63B 9/00* | (2006.01) |
| *F41J 5/24* | (2006.01) |

(52) U.S. Cl.
CPC ..... *A63G 31/007* (2013.01); *A63B 63/00* (2013.01); *A63B 2009/008* (2013.01); *A63F 2250/0421* (2013.01); *A63F 2250/0428* (2013.01); *F41J 5/24* (2013.01)

(58) Field of Classification Search
CPC ..... A63F 2250/0421; A63B 63/00; A63B 2009/008; A63B 2250/0407–2250/0428; A63B 2250/04
USPC ..... 273/383–385
See application file for complete search history.

(56) References Cited

U.S. PATENT DOCUMENTS

| | | | | | |
|---|---|---|---|---|---|
| 2,148,438 | A * | 2/1939 | Crain | F41J 5/24 | 273/378 |
| 4,093,228 | A * | 6/1978 | Pierce | A63B 63/00 | 273/384 |
| 4,466,616 | A * | 8/1984 | Griego | A63B 63/00 | 273/384 |
| 4,702,480 | A * | 10/1987 | Popeski | A63F 9/02 | 273/384 |
| 5,482,292 | A * | 1/1996 | Stone | A63B 63/06 | 273/384 |
| 5,586,767 | A * | 12/1996 | Bohland | A63B 67/00 | 273/349 |
| 5,634,642 | A * | 6/1997 | Grandolfo | A63B 63/00 | 473/423 |
| 5,779,240 | A * | 7/1998 | Santella | F41B 9/0053 | 273/349 |
| 5,848,793 | A * | 12/1998 | Celis | F41J 7/04 | 273/384 |
| 5,947,476 | A * | 9/1999 | Rousay | A63F 9/0079 | 273/384 |
| 6,102,404 | A * | 8/2000 | Barker | A63F 9/02 | 273/379 |
| 6,210,287 | B1 * | 4/2001 | Briggs | A63G 31/00 | 273/394 |
| 6,264,201 | B1 * | 7/2001 | Holsten | F41J 5/18 | 273/384 |
| 6,296,252 | B1 * | 10/2001 | Hubka | A63B 63/00 | 273/384 |
| 6,851,675 | B1 * | 2/2005 | Jakubec | A63B 65/12 | 273/355 |
| 8,336,884 | B1 * | 12/2012 | Pierce | F41J 5/18 | 273/384 |
| 8,702,104 | B2 * | 4/2014 | Legary | F41J 5/056 | 273/371 |

* cited by examiner

*Primary Examiner* — Mark Graham
(74) *Attorney, Agent, or Firm* — Morgan Law Offices, PLC

(57) ABSTRACT

A recreational water spray apparatus is disclosed. The apparatus may be provided a continuous pressurized flow of water without a pump to enhance continuity of a game by eliminating one or more delays to reload a water source. The apparatus may include a target disc disposed on a first end of the target control rod, a user throwing a projectile in an attempt to strike the target disc and upon the projectile striking the target disk, a conical spray of water is dispensed upon one or more user participants. Another embodiment of the recreational water spray apparatus is hinged. The hinged apparatus may allow a one piece upper frame tube and the safety barrier net to move at one or more different angles to a ground surface and allow the recreational water spray apparatus to be folded to create a slimmer profile for storage.

19 Claims, 10 Drawing Sheets

RECREATIONAL WATER SPRAY APPARATUS

BACKGROUND OF THE INVENTION

1. Field of the Invention

The present invention relates to a recreational water spray apparatus.

2. Description of the Related Art

Games and apparatuses involving the recreational utilization of water have existed for many years. Dunk tanks and other water dousing contraptions are the most common target triggered forms of recreational equipment involving the utilization of water.

Recognized water inclusive apparatuses, devices, and games are primarily limited to the dunking or dousing participants with water. Most rely on a vessel to hold a limited or a specific volume of water and rely on gravity to dispense water. Accordingly, there remains room for improvement in these types of apparatuses, devices, and games.

SUMMARY OF THE INVENTION

One aspect of the disclosure relates to a recreational water spray apparatus. The recreational water spray apparatus may be based on the utilization of water as part of an interactive game having target-triggered water mechanisms. The recreational water spray apparatus may involve a user throwing a projectile in an attempt to strike a target disc. Upon the projectile striking the target disc, a spray of water is dispensed upon another user participant.

In an embodiment, a recreational water spray apparatus may be intended for utilization by two or more participants. A user participant positioned behind the apparatus safety barrier is in the line of sight of the water valve discharge nozzle and is in peril of being sprayed with water if a participant positioned in front of the safety barrier successfully throws and strikes the target with a projectile. When impacted by the projectile, the target triggers a valve to open and discharge a conical spray pattern of water onto the user participant positioned behind the apparatus safety barrier net. When the target is returned to its vertical upright position, the valve closes and the flow of water shuts off. The water supply is delivered through a standard garden hose connected to a household water spigot. The advantage of utilizing existing pressurized household water is that the apparatus is provided a continuous flow of water without the need for a pump. The continuous flow of water also eliminates the need for a vessel to be filled with a volume of water. This constant source of water enhances the continuity of the game by eliminating one or more delays to reload a water source. The position of the metered spray nozzle delivers a broad horizontal and upward pattern of water spray onto participants. A safety barrier is secured to the frame and offers full protective coverage to participants positioned behind the barrier. Preferably the barrier is a mesh netting to allow pass thru communication and user participant visibility.

In another embodiment, a recreational water spray apparatus may have a plurality of frame hinges to allow the recreational water spray apparatus to be folded to create a slimmer profile for storage. The recreational water spray apparatus may also have a one piece upper frame tube that may be stronger than the generally rectangular-shape frame that is coupled with a plurality of frame brackets and a plurality of frame hex nuts. The optional frame hinge may allow the optional one piece upper frame tube and the safety barrier net to move to one or more different angles in relation to the ground surface.

The recreational water spray apparatus includes a plurality of frame tube segments having a top frame tube segment, a pair of side frame tube segments, a pair of bottom frame tube segments and a support frame tube segment, the frame tube segments coupled by a plurality of frame brackets forming a generally rectangular-shape frame, the pair of bottom frame tube segments serve as a pair of horizontal supports to support the recreational water spray apparatus in an upright position. The apparatus also includes a safety barrier net coupled inside of the generally rectangular-shape frame and a valve device movably coupled on the support frame tube segment, the valve device vertically raised by a pair of target rod mounting brackets that couple the support frame tube segment, allowing the support frame tube segment and the valve device to be raised-up or down along the pair of the side frame tube segments, the valve device having a valve garden hose connector to receive water to the recreational water spray apparatus and a valve nozzle disposed on the valve device, wherein the recreational water spray apparatus is provided a continuous pressurized flow of water without a pump to enhance continuity of a game by eliminating one or more delays to reload a water source. The apparatus also includes a target disc having a target control rod and a target disc, the target control rod extends horizontally from the valve device and the target disc is disposed on a first end of the target control rod, a user throwing a projectile in an attempt to strike the target disc and upon the projectile striking the target disk, a conical spray of water is dispensed upon one or more user participants from the valve nozzle.

A hinged recreational water spray apparatus includes a plurality of frame tube segments having a one piece upper frame tube, a pair of side frame tube segments, a pair of bottom frame tube segments and a support frame tube segment, the frame tube segments coupled by a plurality of frame hinges forming a generally rectangular-shape frame, the pair of bottom frame tube segments serve as a pair of horizontal supports to support the recreational water spray apparatus in an upright position. The apparatus may also include a safety barrier net coupled inside of the generally rectangular-shape frame, a valve device movably coupled on the support frame tube segment, the valve device vertically raised by a pair of target rod mounting brackets that couple the support frame tube segment, allowing the support frame tube segment and the valve device to be raised-up or down along the pair of the side frame tube segments, the valve device having a valve garden hose connector to receive water to the recreational water spray apparatus and a valve nozzle disposed on the valve device. The apparatus also includes a target disc having a target control rod and a target disc, the target control rod extends horizontally from the valve device and the target disc is disposed on a first end of the target control rod, a user throwing a projectile in an attempt to strike the target disc and upon the projectile striking the target disk, a conical spray of water is dispensed upon one or more user participants from the valve nozzle.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF THE INVENTION

Figure 1:
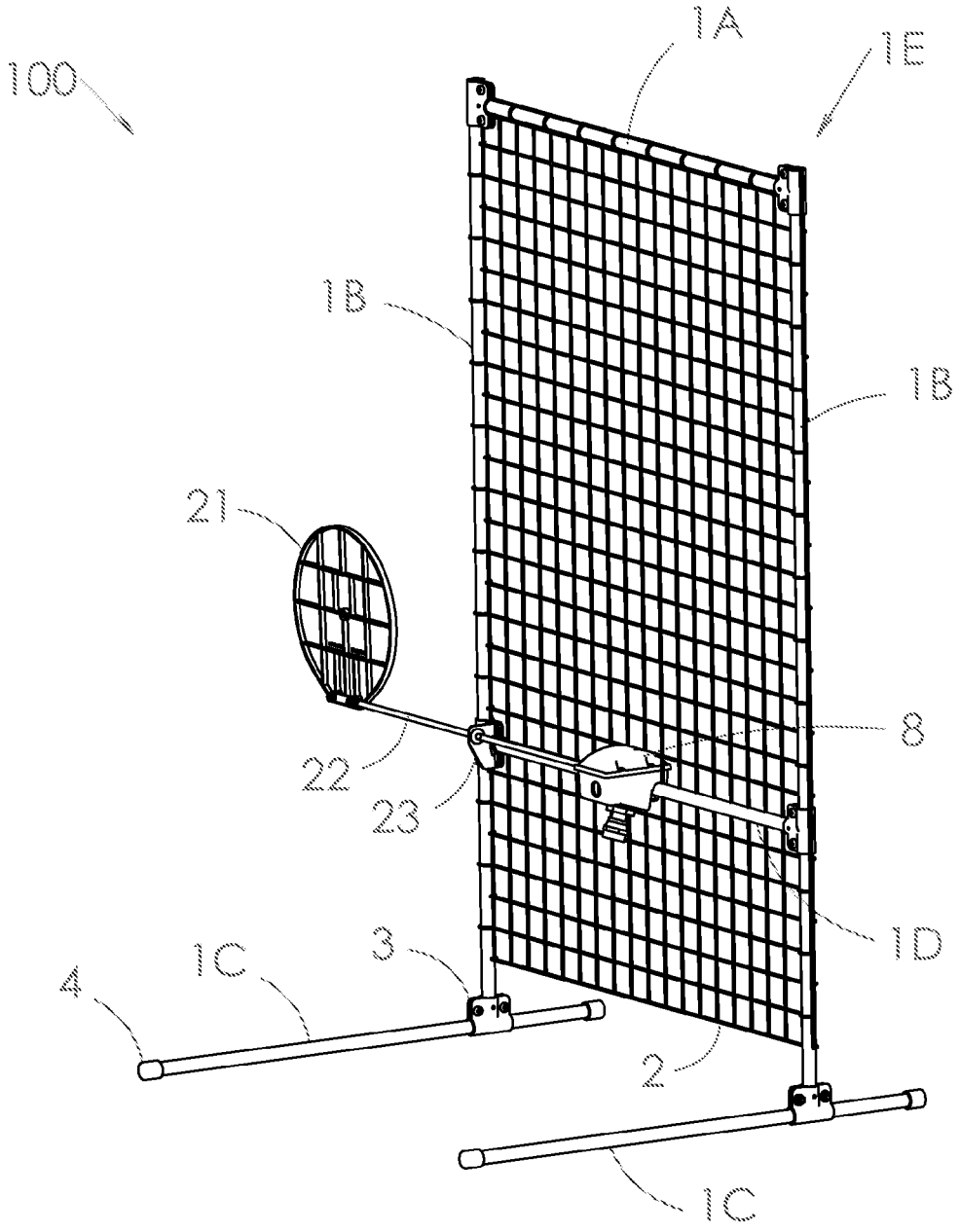
FIG. 1 illustrates a perspective view of a fully assembled recreational water spray apparatus.
Figure 2:
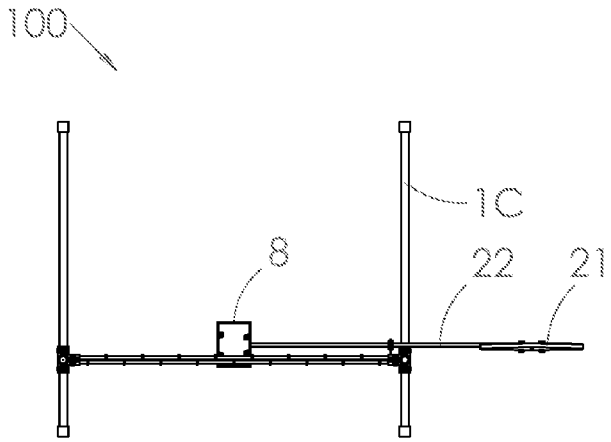
FIG. 2 illustrates a top view of the fully assembled recreational water spray apparatus.
Figure 3:
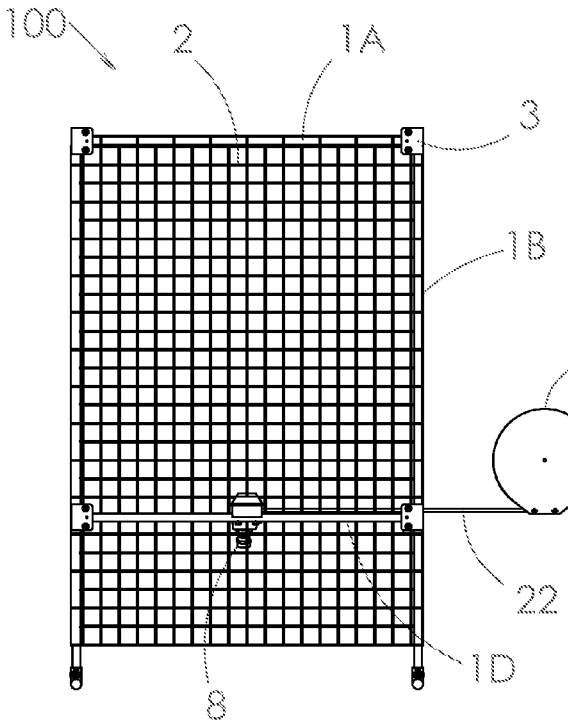
FIG. 3 illustrates a front view of the fully assembled recreational water spray apparatus.
Figure 4:
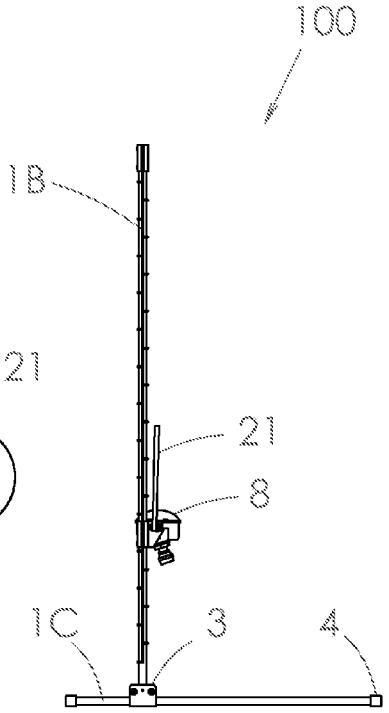
FIG. 4 illustrates a side view of the fully assembled recreational water spray apparatus.

FIG. 1 illustrates a front perspective view of a fully assembled recreational water spray apparatus 100, according to an embodiment. FIGS. 2-4 illustrate top, front and side views, respectively, of the fully assembled recreational water spray apparatus 100.

As shown, the recreational water spray apparatus 100 includes a plurality of frame tube segments 1A-1D, a safety barrier net 2, a valve device 8 and a target disc 21. The frame tube segments 1A-1D comprise a top frame tube segment 1A, a pair of side frame tube segments 1B, a pair of bottom frame tube segments 1C and a support frame tube segment 1D. The frame tube segments 1A-1D can be coupled by a plurality of frame brackets 3 forming a generally rectangular-shape frame 1E. The safety barrier net 2 is coupled inside of the generally rectangular-shape frame 1E. The bottom frame tube segments 1C serves as a pair of horizontal supports to support the recreational water spray apparatus 100 in an upright position. A pair of ends 1C' of each of the bottom frame tube segments 1C have a frame end cap 4 disposed on each of the ends 1C' to protect the ends 1C' of the bottom frame tube segments 1C.

The valve device 8 is coupled on the support frame tube segment 1D. The valve device 8 is vertically raised by a pair of target rod mounting brackets 23 that couple the support frame tube segment 1D and the valve device 8 with the pair of the side frame tube segments 1B, allowing the support frame tube segment 1D and the valve device 8 to be raised-up or down along the pair of the side frame tube segments 1B. The target disc 21 includes a target control rod 22 attached thereto. More particularly, the target control rod 22 extends horizontally from the valve device 8 and the target disc 21 is disposed on a first end 22A of the target control rod 22. The safety barrier net 2 can be a mesh netting made of nylon or cotton twine, for example. The safety barrier net 2 prevents one or more projectiles such as balls, bean bags and the like (all not shown) from striking a participant situated behind the safety barrier net 2. The safety barrier net 2 may also may also be useful for preventing one or more projectiles from damaging nearby objects and the like.

Figure 5:
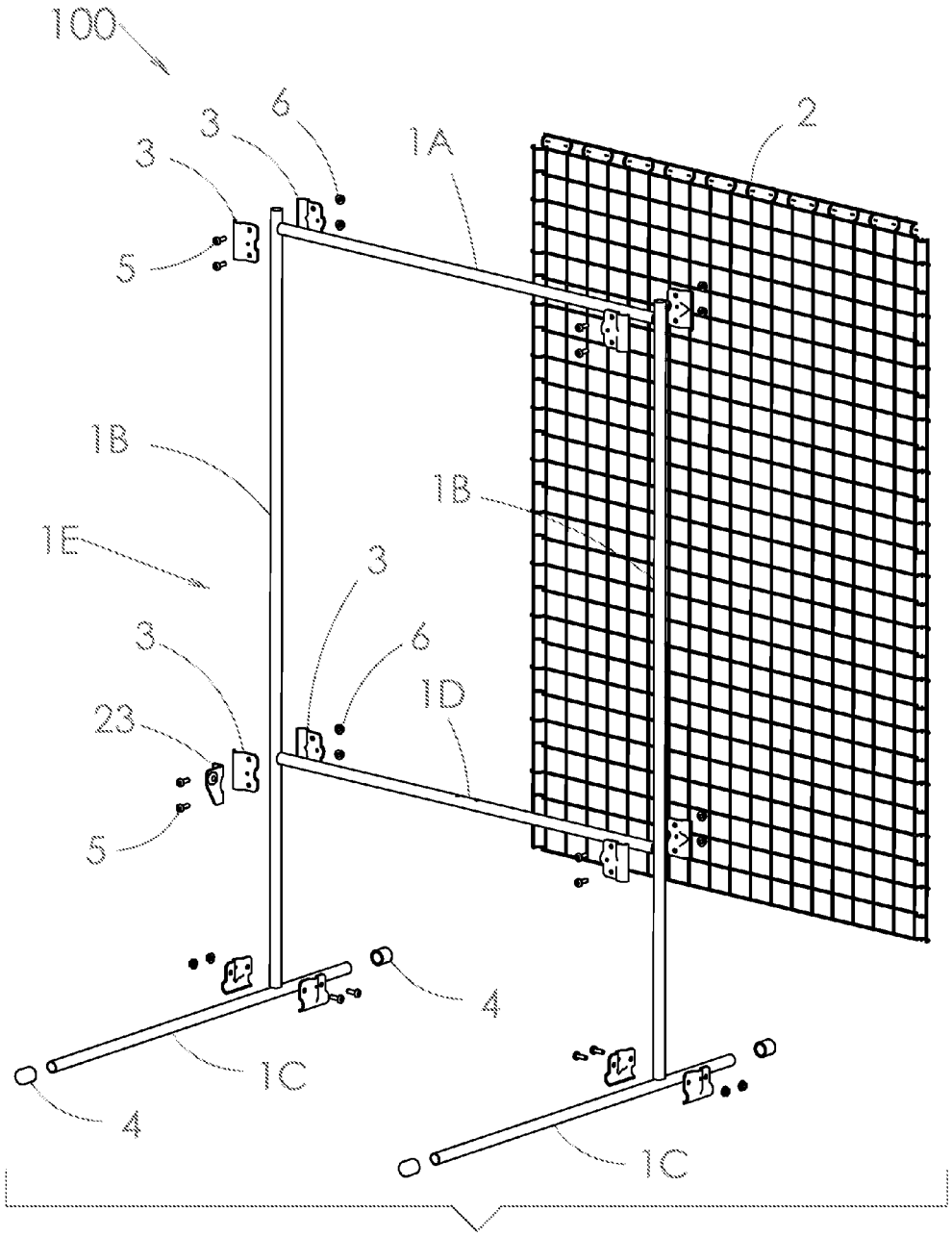
FIG. 5 illustrates a front exploded perspective view of the recreational water spray apparatus.

FIG. 5 illustrates a front fully exploded perspective view of the recreational water spray apparatus 100. As can be seen, each of the brackets 6 is coupled to a respective frame tube segment 1A-1D using a screw 5/hex nut 6 combination. A frame hex nut may be much easier to grip with wrenches or the like than other fasteners. This makes it much easier for users to remove the hex nuts 6 and provide a level of security since only a hex nut tool (not shown) needs to be utilized to tighten or remove the hex nut 6 from the screw 5.

Figure 6:
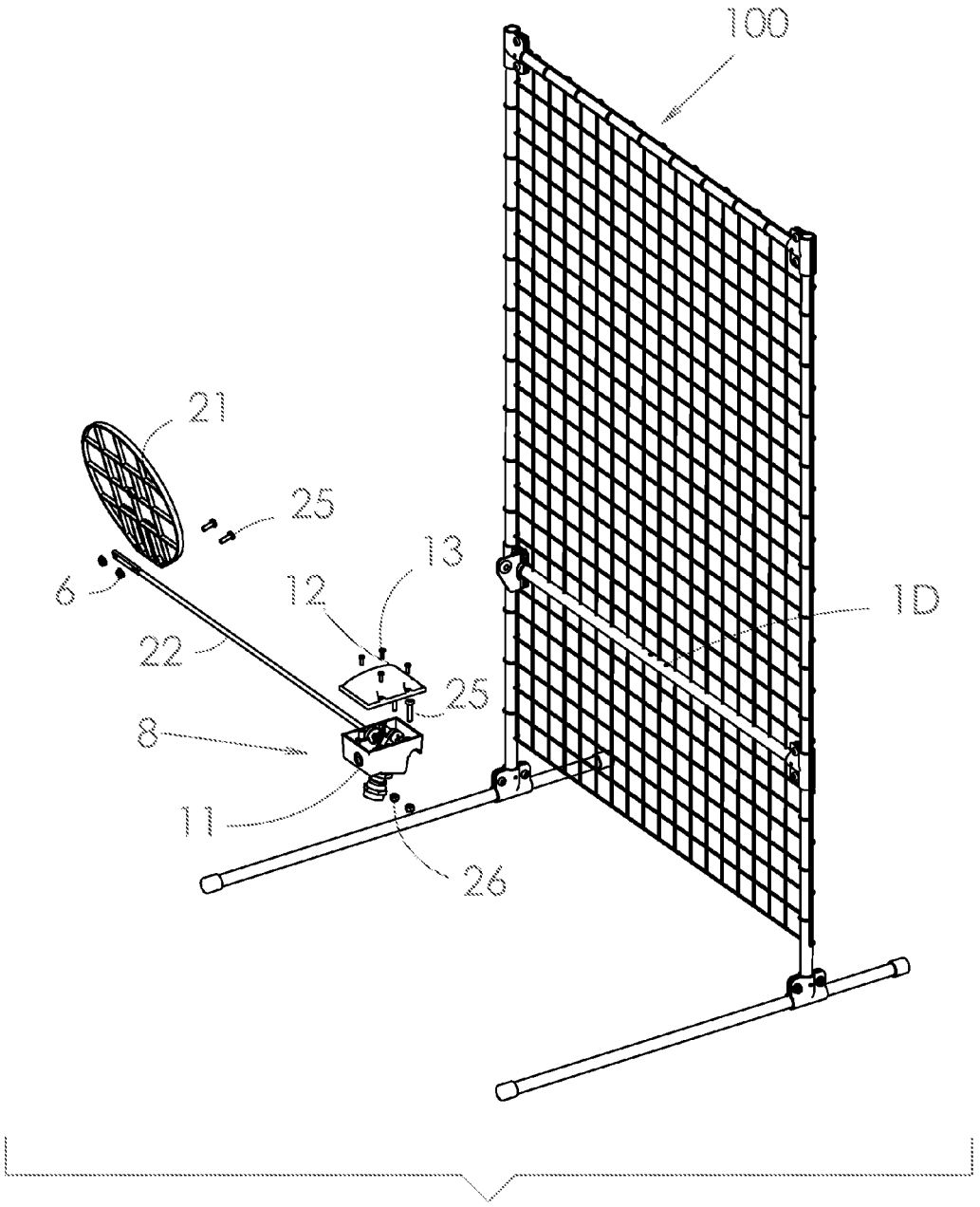
FIG. 6 illustrates a partial exploded front perspective view of the recreational water spray apparatus.

FIG. 6 illustrates an exploded front perspective view of the recreational water spray apparatus 100. As shown, the target disk can be attached to a side the target control rod using a screw 25/hex nut. The valve device 8 includes a valve upper housing 12 and a valve lower housing 11, the valve upper housing 12 and the valve lower housing 11 attached together with a plurality of valve housing screws 13.

Figure 7:
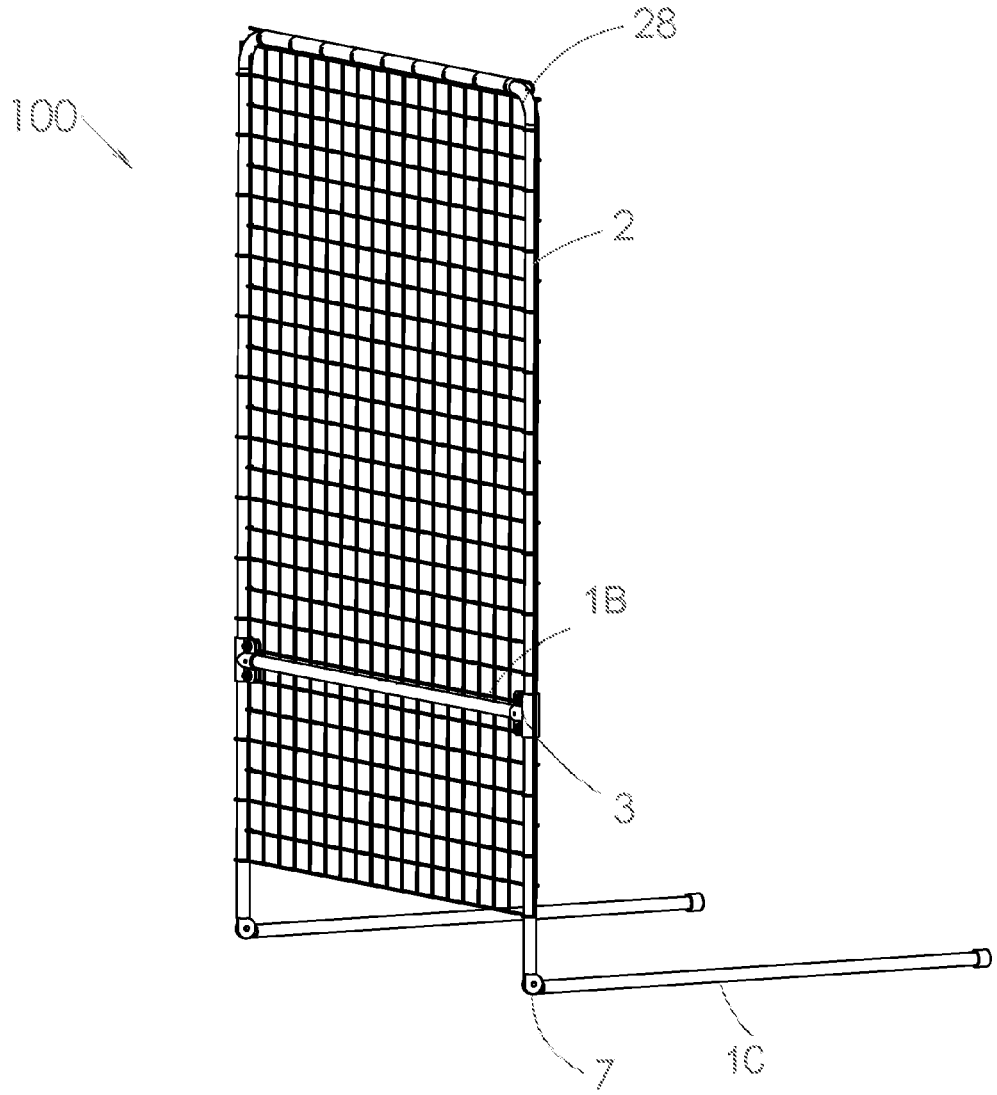
FIG. 7 illustrates another design for the framing of the recreational water spray apparatus.

FIG. 7 illustrates a front perspective view of the fully assembled recreational water spray apparatus 100. The recreational water spray apparatus 100 may include an optional one piece upper frame tube 1A, a safety barrier net 2, a valve mount frame tube segment 1D, a frame bracket 3, an optional frame hinge 7 and a bottom frame tube segment 1C. This alternative embodiment combines the two side frame tube segments 1B and the upper frame tube 28 into a singular one piece upper frame tube 28. The optional one piece upper frame tube 28 may be stronger than the generally rectangular-shape frame (FIG. 1, 1E) that is coupled with a plurality of frame brackets 3 using screw 5/hex nuts 6 combinations. The optional frame hinge 7 may allow the optional one piece upper frame tube 28 and the safety barrier net 2 to fold for easier storage.

Figure 8:
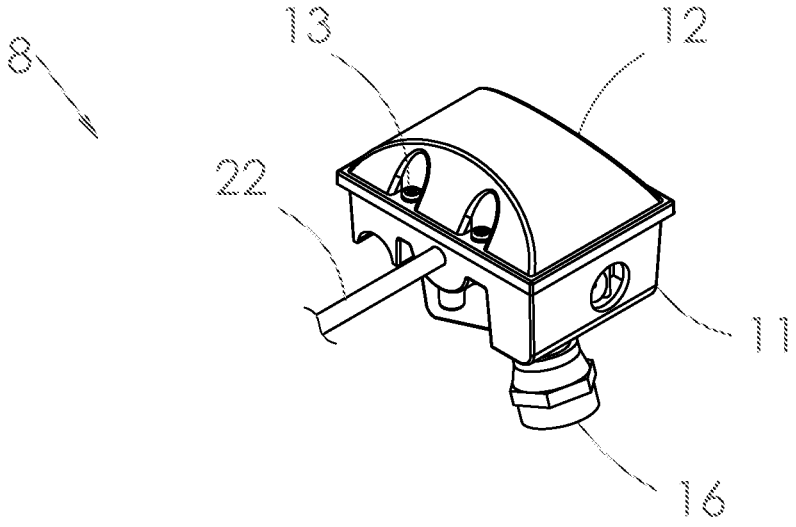
FIG. 8 illustrates a side perspective view of a valve device.
Figure 9:
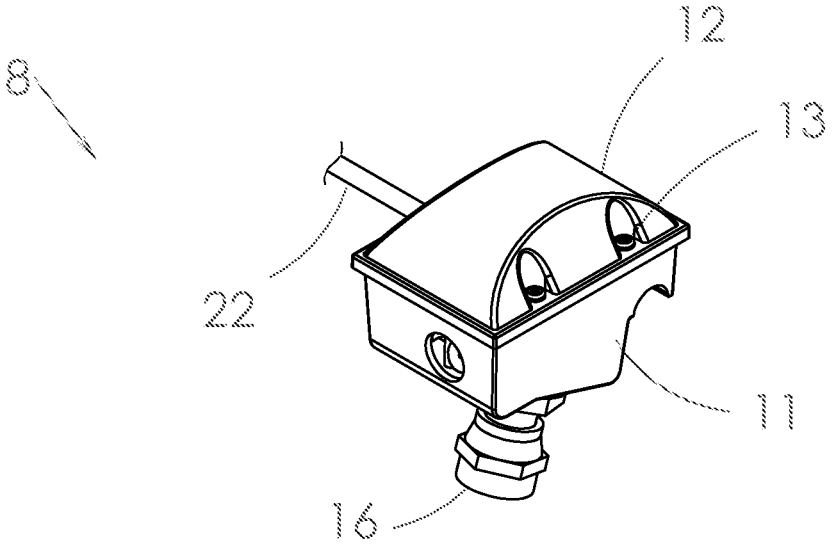
FIG. 9 illustrates another side perspective view of the valve device of FIG. 8.

FIGS. 8-9 illustrate side perspective views of the valve device 8. The valve device 8 includes the valve upper housing 12 and the valve lower housing 11, the valve upper housing 12 and the valve lower housing 11 attached together with a plurality of valve housing screws 13. The valve device 8 includes openings to accommodate the valve garden hose connector 16 and the target control rod 22.

Figure 10:
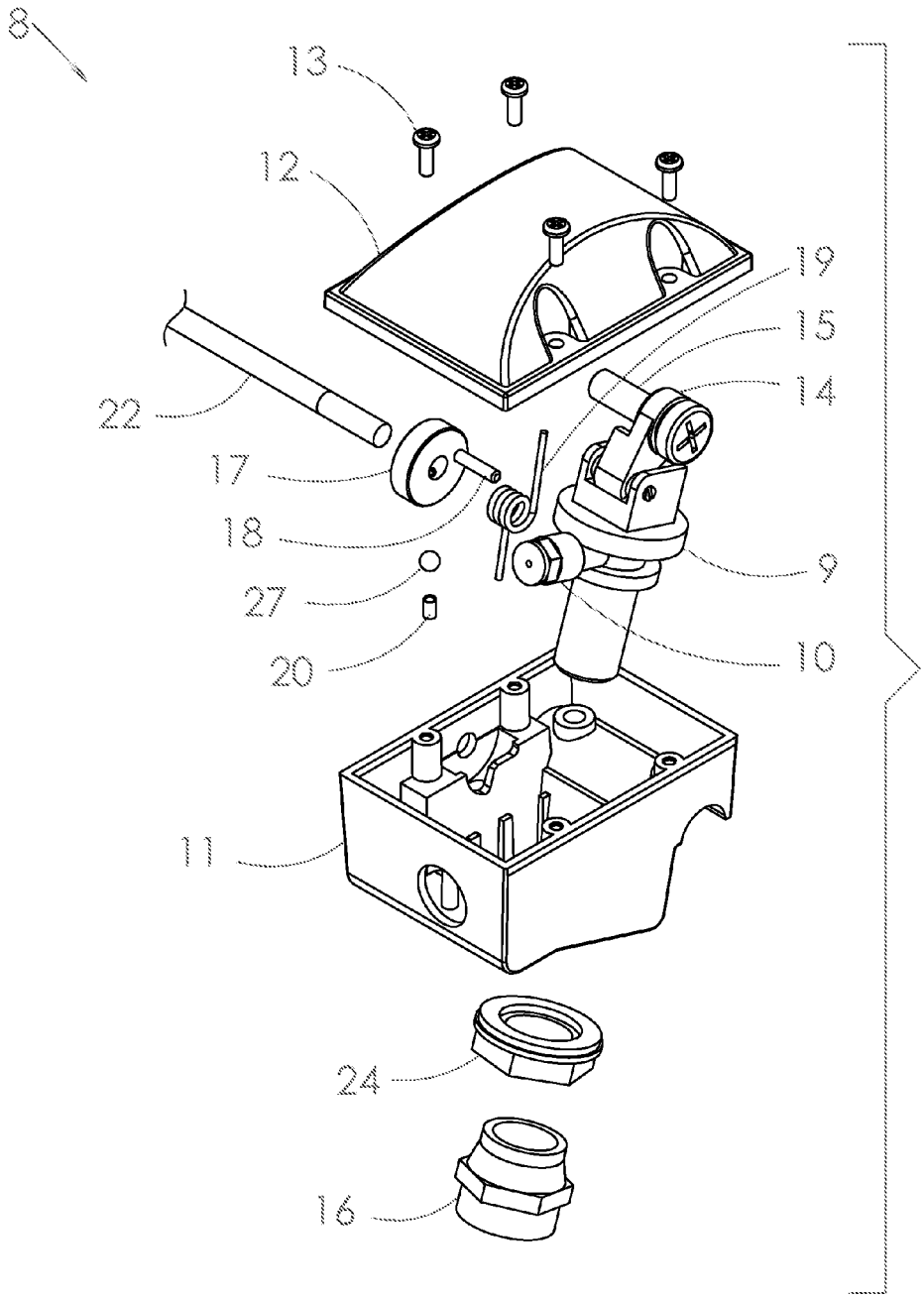
FIG. 10 illustrates an exploded side perspective view of the valve device, according to a first embodiment of the valve device.
Figure 11:
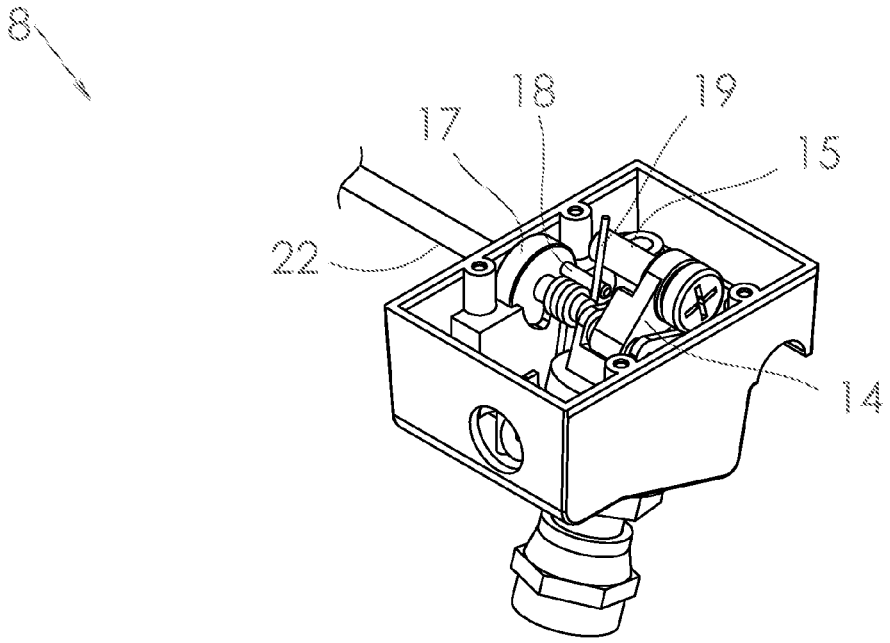
FIG. 11 illustrates an open view of the valve device of FIG. 10 in a closed position.
Figure 12:
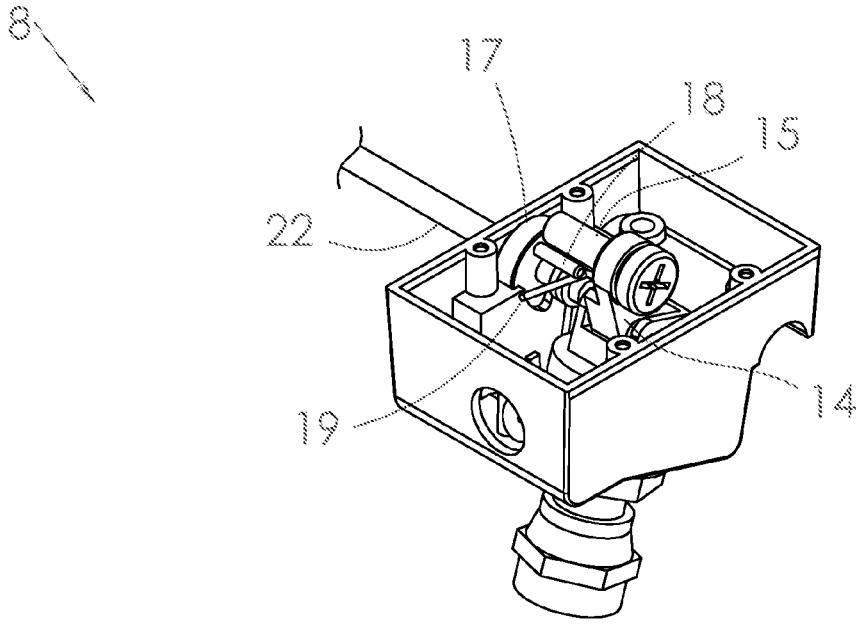
FIG. 12 illustrates an open view of the valve device of FIG. 10 in an open position.
Figure 13:
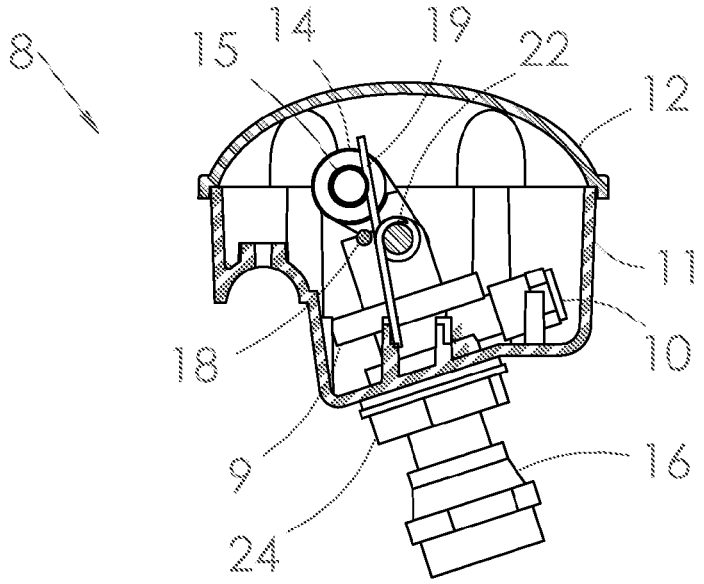
FIG. 13 illustrates an open side view of the valve device of FIG. 10 in a closed position.
Figure 14:
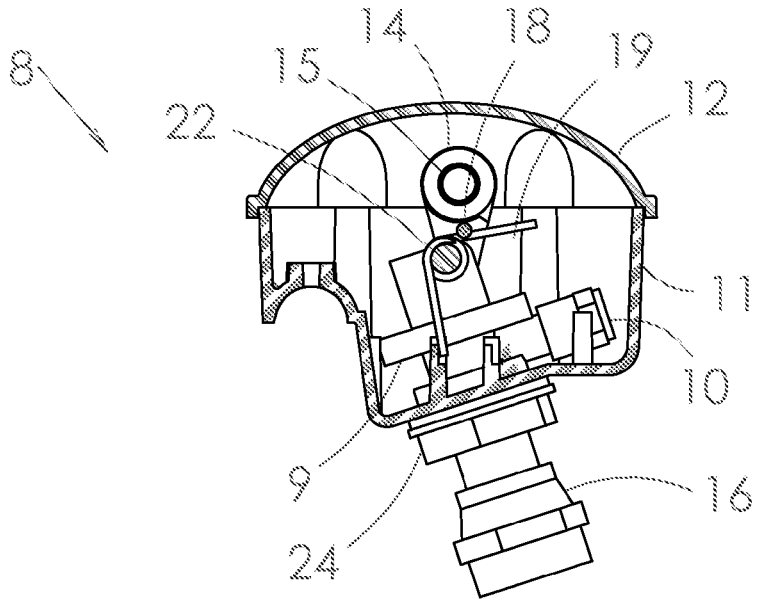
FIG. 14 illustrates an open side view of the valve device of FIG. 10 in an open position.

FIG. 10 illustrates an exploded side perspective view of the valve device 8, according to a first embodiment of the valve device 8. FIGS. 11-12 illustrate the valve device 8 with the valve upper housing 12 removed, in a closed position and an open position, respectively, according to the first embodiment. FIGS. 13-14 illustrate side views of the valve device in a closed position and an open position, respectively.

As illustrated, the valve device 8 includes a valve 9 which can be fluidly attached to a garden hose via a valve garden hose connector 16. The valve garden hose connector 16 can be connected to the lower housing 11 using a valve mounting nut 24. Connected to the valve 9 is a valve link 14. The valve 9 can be transitioned to its "open" position by pivoting the valve link 14 in the direction of the valve nozzle 10. When the valve 9 is open, the valve 9 allows pressurized water to flow through the valve 9 and spray from the valve nozzle 10.

To link rotation of the target control rod 22 to operation of the valve 9, the following mechanism is provided. The target control rod 22 includes a shaft collar 17 and a torsion spring 19 attached to a distal end of the target control rod 22. More particularly, the distal end of the target control rod 22 extends through a central hole in the shaft collar 17 and then the coil portion of the torsion spring 19. The shaft collar 17 includes a protruding shaft collar trigger 18. A valve tensioner band mounting bolt 15 extends through the valve link 14, approximately parallel to the target control rod 22. The torsion spring 19 includes a first end fixedly anchored and a second end disposed adjacent the shaft collar 17 and the valve tensioner band mounting bolt 15, as shown. Additionally, a detent ball 27 can be used for more precise operation. The detent ball 27 can be disposed on a detent spring 20 and pressed into a detent hole on a perimeter of the shaft collar 17 (not shown), such that an initial amount of force must be exerted for rotation of the shaft collar 17.

In the closed position, water pressure will force the valve tensioner band mounting bolt 15 against the second end of the torsion spring 19 but not sufficiently to overcome the tension of the torsion spring 19. However, when target disc 21 is struck by a projectile, the target control rod 22 is forced to rotate approximately 180°. The rotation causes the shaft collar trigger 18 to push the second end of the torsion spring 19 so as to permit the valve tensioner band mounting bolt 15 and thus the valve link 14 to shift the valve 9 from a closed position to an open position, as shown in FIGS. 12 and 14.

Figure 15:
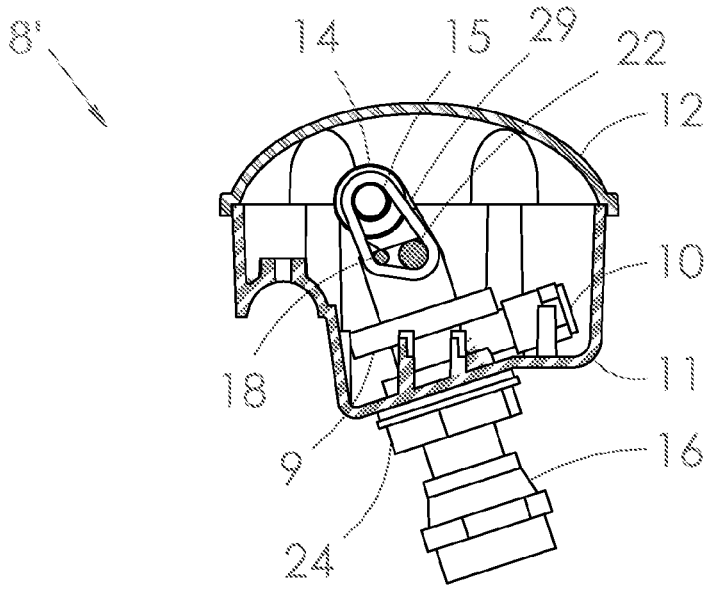
FIG. 15 illustrates a side view of a valve device, according to a second embodiment of the valve device, shown in a closed position.
Figure 16:
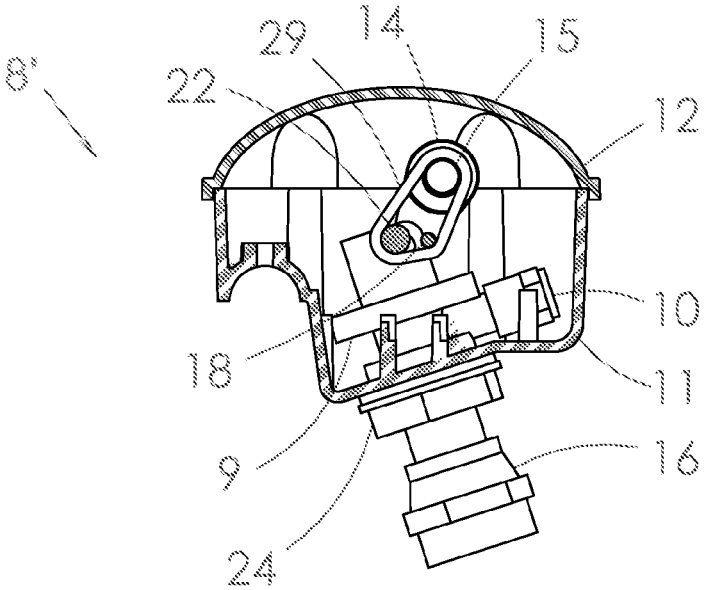
FIG. 16 illustrates a side view of the valve device of FIG. 15 in an open position.

FIGS. 15-16 illustrate side views of a valve device 8', according to a second embodiment, in a closed position and an open position, respectively. The valve device 8' is similar to the valve device 8. However, an elastomer band 29 is used instead of the torsion spring 19. As shown, the elastomer band 29 is wound around the distal end of the target control rod 22, the shaft collar trigger 18 and the valve tensioner band mounting bolt 15. In the closed position (FIG. 15), the shaft collar trigger 18 is positioned to pull the elastomer band 29 so as to stretch the elastomer band 29 to hold the valve tensioner band mounting bolt 15 from allowing the valve link 14 to pivot to an open position. In the open position (FIG. 16), the shaft collar trigger 18 rotates with the target control rod 22 and as it does the tension of the elastomer band 29 is released allowing the valve link 14 to pivot to an open position. In the open position, the elastomer band 29 is positioned to pull the elastomer band 29 so as to hold the valve 9 in the open position assisted by water pressure.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A recreational water spray apparatus, comprising:

a plurality of frame tube segments having a top frame tube segment, a pair of side frame tube segments, a pair of bottom frame tube segments and a support frame tube segment, the frame tube segments coupled by a plurality of frame brackets forming a generally rectangular-shape frame, the pair of bottom frame tube segments serve as a pair of horizontal supports to support the recreational water spray apparatus in an upright position;

a safety barrier net coupled inside of the generally rectangular-shape frame;

a valve device movably coupled on the support frame tube segment, the valve device vertically raised by a pair of target rod mounting brackets that couple the support frame tube segment, allowing the support frame tube segment and the valve device to be raised-up or down along the pair of the side frame tube segments, the valve device having a valve garden hose connector to receive water to the recreational water spray apparatus and a valve nozzle disposed on the valve device, wherein the recreational water spray apparatus is provided a continuous pressurized flow of water without a pump to enhance continuity of a game by eliminating one or more delays to reload a water source; and a target disc having a target control rod and a target disc, the target control rod extends horizontally from the valve device and the target disc is disposed on a first end of the target control rod, a user throwing a projectile in an attempt to strike the target disc and upon the projectile striking the target disk, a spray of water is dispensed from the valve nozzle.

2. The recreational water spray apparatus according to claim 1, further comprising a plurality of fasteners utilized in combination with the frame brackets to couple the frame tube segments.

3. The recreational water spray apparatus according to claim 1, further comprising a pair of ends of each of the pair of bottom frame tube segments having a frame end cap disposed on each of the pair of ends to protect the pair of ends.

4. The recreational water spray apparatus according to claim 1, wherein the safety barrier net is a mesh netting to allow pass thru communication and the one or more users participant visibility.

5. The recreational water spray apparatus according to claim 4, wherein the mesh netting is made of nylon.

6. The recreational water spray apparatus according to claim 4, wherein the mesh netting is made of cotton twine.

7. The recreational water spray apparatus according to claim 1, wherein the valve nozzle is discharging water in a conical spray pattern, the conical spray pattern creating broader coverage that is more water conservative than a stream of water or pouring of a contained volume of water.

8. The recreational water spray apparatus according to claim 1, wherein the valve garden hose connector is disposed on a bottom portion of the valve device.

9. The recreational water spray apparatus according to claim 1, wherein a user participant is positioned behind the safety barrier net.

10. A hinged recreational water spray apparatus, comprising:

a plurality of frame tube segments having a one piece upper frame tube, a pair of side frame tube segments, a pair of bottom frame tube segments and a support frame tube segment, the frame tube segments coupled by a plurality of frame hinges forming a generally rectangular-shape frame, the pair of bottom frame tube segments serve as a pair of horizontal supports to support the recreational water spray apparatus in an upright position;

a safety barrier net coupled inside of the generally rectangular-shape frame;

a valve device movably coupled on the support frame tube segment, the valve device vertically raised by a pair of target rod mounting brackets that couple the support frame tube segment, allowing the support frame tube segment and the valve device to be raised-up or down along the pair of the side frame tube segments, the valve device having a valve garden hose connector to receive water to the recreational water spray apparatus and a valve nozzle disposed on the valve device; and a target disc having a target control rod and a target disc, the target control rod extends horizontally from the valve device and the target disc is disposed on a first end of the target control rod, a user throwing a projectile in an attempt to strike the target disc and upon the projectile striking the target disk, a spray of water is dispensed upon one or more user participants from the valve nozzle.

11. The recreational water spray apparatus according to claim 10, further comprising a plurality of fasteners in combination with the frame brackets to couple the frame tube segments.

12. The recreational water spray apparatus according to claim 10, further comprising a pair of ends of each of the pair of bottom frame tube segments having a frame end cap disposed on each of the pair of ends to protect the pair of ends.

13. The recreational water spray apparatus according to claim 10, wherein the frame hinges allow the one piece upper frame tube and the safety barrier net to fold.

14. The recreational water spray apparatus according to claim 13, wherein the frame hinges allow the recreational water spray apparatus to be folded to create a slimmer profile for storage.

15. The recreational water spray apparatus according to claim 10, wherein the safety barrier net is a mesh netting to allow pass thru communication and the one or more users participant visibility.

16. The recreational water spray apparatus according to claim 15, wherein the mesh netting is made of nylon.

17. The recreational water spray apparatus according to claim 15, wherein the mesh netting is made of cotton twine.

18. The recreational water spray apparatus according to claim 10, wherein the valve nozzle is discharging water in a conical spray pattern, the conical spray pattern creating broader coverage that is more water conservative than a stream of water or pouring of a contained volume of water.

19. The recreational water spray apparatus according to claim 10, wherein the valve garden hose connector is disposed on a bottom portion of the valve device.

* * * * *